US011117016B2

(12) United States Patent
Kollreider et al.

(10) Patent No.: US 11,117,016 B2
(45) Date of Patent: Sep. 14, 2021

(54) APPARATUS FOR TRAINING A PERSON'S LOWER AND/OR UPPER EXTREMITIES

(71) Applicant: TYROMOTION GMBH, Graz (AT)

(72) Inventors: Alexander Kollreider, Graz (AT); David Ram, Graz (AT)

(73) Assignee: TYROMOTION GMBH, Graz (AT)

( * ) Notice: Subject to any disclaimer, the term of this patent is extended or adjusted under 35 U.S.C. 154(b) by 31 days.

(21) Appl. No.: 16/462,219

(22) PCT Filed: Nov. 21, 2017

(86) PCT No.: PCT/EP2017/079902
§ 371 (c)(1),
(2) Date: Aug. 5, 2019

(87) PCT Pub. No.: WO2018/091731
PCT Pub. Date: May 24, 2018

(65) Prior Publication Data

US 2020/0016453 A1 Jan. 16, 2020

(30) Foreign Application Priority Data

Nov. 21, 2016 (EP) ..... 16199806

(51) Int. Cl.
*A63B 22/06* (2006.01)
*A63B 21/00* (2006.01)
(Continued)

(52) U.S. Cl.
CPC ..... *A63B 22/0605* (2013.01); *A61H 1/0214* (2013.01); *A63B 21/00178* (2013.01);
(Continued)

(58) Field of Classification Search
CPC . A63B 22/06; A63B 22/0605; A63B 22/0664; A63B 22/0694; A63B 21/00178;
(Continued)

(56) References Cited

U.S. PATENT DOCUMENTS 3,711,089 A 1/1973 Reinhard
3,721,438 A 3/1973 Kusmer
(Continued)

FOREIGN PATENT DOCUMENTS

CN 2657719 Y 11/2004
DE 299 22 913 U1 5/2000
(Continued)

OTHER PUBLICATIONS

Extended European Search Report dated May 19, 2017 as received in Application No. 16199806.7.
(Continued)

*Primary Examiner* — Garrett K Atkinson
*Assistant Examiner* — Zachary T Moore
(74) *Attorney, Agent, or Firm* — Maschoff Brennan

(57) ABSTRACT

It is provided an apparatus for training a person's lower and/or upper extremities, comprising at least two motion elements which are arranged on a base element, wherein the motion elements each have an axis of rotation around which an actuating element can be moved. The motion elements each are independently movable relative to the base element about a first axis of movement, wherein the first axis of movement extends substantially perpendicular to an extension surface of the base element. Each motion element has a separate drive in order to rotate the actuating elements about the axis of rotation, and that the apparatus includes a control element which can individually actuate each drive in order to provide for a movement of each drive independent of a movement of another drive.

14 Claims, 4 Drawing Sheets

(51) Int. Cl.
*A63B 22/00* (2006.01)
*A61H 1/02* (2006.01)

(52) U.S. Cl.
CPC ..... *A63B 22/0005* (2015.10); *A63B 22/0007* (2013.01); *A63B 22/0694* (2013.01)

(58) Field of Classification Search
CPC .... A63B 2022/0028; A63B 2022/0038; A63B 2022/0041; A63B 2022/0611; A63B 2022/0617; A63B 2022/0623; A63B 2022/0629; A63B 2022/0635; A63B 2022/0647; A63B 2022/0652; A63B 2022/0658; A63B 2022/067; A63B 2022/0676; A63B 2022/0688; A61H 1/0214
See application file for complete search history.

(56) References Cited

U.S. PATENT DOCUMENTS

| | | | | |
|---|---|---|---|---|
| 4,973,046 | A | 11/1990 | Maxwell | |
| 7,282,014 | B2 * | 10/2007 | Krietzman ..... | A63B 21/0603 482/114 |
| 8,608,625 | B2 | 12/2013 | Quarz | |
| 9,044,630 | B1 * | 6/2015 | Lampert ..... | A63B 23/04 |
| 9,199,114 | B1 | 12/2015 | Santoro | |
| 9,320,935 | B1 | 4/2016 | Paris | |
| 2005/0004352 | A1 | 1/2005 | Kontermann et al. | |
| 2005/0043152 | A1 | 2/2005 | Krietzman | |
| 2009/0069157 | A1 | 3/2009 | Wilhelm | |
| 2014/0081186 | A1 * | 3/2014 | Paris ..... | A63B 23/1209 601/33 |

FOREIGN PATENT DOCUMENTS

| | | | | |
|---|---|---|---|---|
| DE | 103 16 688 | A1 | 9/2004 | |
| DE | 10 2004 020006 | A1 | 11/2005 | |
| DE | 102004020006 | A1 * | 11/2005 | ..... A63B 21/00178 |
| DE | 20 2009 013848 | U1 | 2/2010 | |
| EP | 2 127 702 | A1 | 12/2009 | |
| EP | 2 010 121 | B1 | 12/2011 | |
| WO | 2006/069988 | A1 | 7/2006 | |
| WO | 2016/032416 | A1 | 3/2016 | |
| WO | 2016032413 | A1 | 3/2016 | |

OTHER PUBLICATIONS

CN Office Action in Application No. 201780083949.4 dated Aug. 19, 2020.

* cited by examiner

APPARATUS FOR TRAINING A PERSON'S LOWER AND/OR UPPER EXTREMITIES

CROSS-REFERENCE TO A RELATED APPLICATION

This application is a National Phase Patent Application of International Patent Application Number PCT/EP2017/079902, filed on Nov. 21, 2017, which claims priority of European Patent Application Number 16199806.7, filed on Nov. 21, 2016.

BACKGROUND

The disclosure relates to an apparatus for training a person's lower and/or upper extremities and methods for controlling and adjusting such an apparatus. Such an apparatus can also be referred to as a training device for training a person's motor skills. It is suitable in particular for training the upper extremities, i.e. the arms, and/or the lower extremities, i.e. the legs, of a person.

Numerous training devices for the upper and lower extremities are known from the prior art. For example, there are mobile training devices which can be put up on the floor with a base element to which two pedals with pedal arms are mounted as actuating elements. These pedals can then be actuated by a user like riding a bicycle. Optionally, in such devices the pedals can be exchanged for handles with a crank so that the device can be operated like a so-called handbike when it is standing on a table.

What is likewise known are devices which include two pedals with pedal arms and in addition two handles. With such devices a user can train the upper and lower extremities at the same time by actuating the pedals either sitting or standing as with a bicycle and at the same time by actuating the handles as with a handbike.

Furthermore, there are training devices which can be operated by a user lying in a bed. For this purpose, such a device includes a movable rack with a boom which then extends across the bed. At the free end of the boom two pedals with pedal arms are mounted, which are actuated by the user like riding a bicycle. In such devices the pedals can again be exchanged for handles with a crank so that the device can be operated like a handbike. The common axis of rotation of the pedals or the handles advantageously can be moved relative to the boom about an axis perpendicular to the axis of rotation so that the rack with the boom can be pushed towards the lying user from different sides of the bed without the user having to change his position.

In all of these devices the left and the right pedal or the left and the right handle each rotate about the same axis and are mechanically coupled to each other, i.e. both pedals or handles always move jointly.

From U.S. Pat. No. 3,711,089 A there are also known ski training devices in which the skis are running on front and rear rollers. Optionally, front and rear rollers are driven in opposite directions so that with a corresponding weight transfer of the user the skis are alternately moved forwards and backwards. Furthermore, two drives can be provided, one for rollers for the right ski and one for rollers for the left ski so that the left and right rollers and hence the left and right skis can have different speeds of rotation. The geometric arrangement of the rollers cannot be changed.

DE 299 22 913 U1 discloses a training device, in particular for physically disabled persons, comprising a stationary or movable rack and a lifting member variable in height by means of a drive, on which a carrier device for the person to be trained is arranged. By lifting and lowering the lifting member, the person for example can be brought from a sitting into a standing position and vice versa. When the rack is of bridge-like design, there are preferably used two drives which are arranged in both rack posts and in the two end regions of the rack carrier or the lifting member.

DE 103 16 688 A1 describes a training device comprising at least two standing surfaces movable relative to a device frame for one foot each of a user, and comprising a motor drive for generating a rolling or swiveling movement of the standing surfaces relative to each other.

What is known from WO 2006/069988 A1 is a bicycle vibration ergometer comprising a frame with a seat unit, a pedal bearing and crank unit as well as a vibration unit, wherein the vibration unit is connected to the pedal bearing/crank unit and the pedal bearing/crank unit is mechanically decoupled from the seat unit.

WO 2016/032416 A1 discloses a movement training device in order to train the walking movements of a user. The user is held by loops in order to relieve the lower extremities. The legs are guided during the walking movement so that a purely passive user also is able to perform a walking movement.

EP 2 010 121 B1 relates to a training device for a training of a person's musculoskeletal system, comprising a seesaw carrying the person, which is pivotable with respect to a seesaw carrier, and a drive arrangement with at least one motor and a transmission including transmission elements, wherein the transmission elements form at least one power transmission chain between the seesaw and the motor.

U.S. Pat. No. 3,721,438 A describes a training device which includes a pair of rotatable arms that are mounted on a movable rack. To the arms handles can be mounted. With this training device an active training (without motor support) is possible.

US 2005/004352 A1 describes a training device which comprises two handles disposed substantially opposite each other, which can be moved by a user. It is also possible that the handles are mounted on a common base module which a user for example can position on his lap.

U.S. Pat. No. 9,320,935 B1 describes a training device with a seat and two resistance wheels accommodated in a common housing, which include hand or foot pedals. The resistance applied by the resistance wheels is adjustable.

U.S. Pat. No. 4,973,046 A describes a training device with two pedals which are driven by a common motor. An individual adaptation of the pedals to the needs of the user is possible. The motor speed can be adjusted when necessary.

U.S. Pat. No. 9,199,114 B1 describes a training device with which arm movements can be trained. The training device provides for an active training (without motor support). It is possible to detect and display certain parameters such as the pulse rate of a user, the time, the energy consumption or a virtual covered distance via a control unit. This can also be effected for example via a smartphone app.

SUMMARY

Proceeding from this prior art it is the object to provide a training device for training a person's motor skills, which has more flexible adjustment possibilities and more individually adjustable training modes than the training devices known from the prior art. The flexibility can relate for example to the geometry of the apparatus and/or to the operation of the apparatus so as to provide for an optimum adaptation to each user and to each training purpose.

This object is solved by an apparatus for training a person's lower and/or upper extremities, which comprises the following features.

First of all, the apparatus includes at least two motion elements which are arranged on a base element. The motion elements each have an axis of rotation around which one actuating element each can be moved. The motion elements each are independently movable relative to the base element about a first axis of movement. The first axis of movement extends substantially perpendicular to a surface in which the base element extends.

Due to an independent movement of the motion elements relative to the base element it is possible to individually adapt the alignment of the motion elements to a user and thus achieve the optimum adjustment of the apparatus according to the proposed solution for the user.

According to the proposed solution, the apparatus is characterized in that each motion element has a separate drive (a separate motor) in order to rotate the actuating elements about the axis of rotation. In addition, the apparatus includes a control element which can individually actuate each drive. In this way it is possible that each drive can be actuated and moved independent of another drive of the same apparatus, whereby ultimately a different movement of the individual actuating elements of the apparatus becomes possible.

The term "substantially" indicates an angular range of plus/minus 5° about the concretely indicated geometric relationship. "Substantially perpendicular" thus refers to an angular range of 85° to 95° and includes "perpendicular" (90°). "Substantially parallel" thus refers to an angular range of −5° (355°) to +5° (5°) and includes "parallel" (0°).

The individual motion elements can be identically constructed, but need not be so.

When the drives are switched off, the apparatus according to the proposed solution can be used for actively training a person's lower and/or upper extremities.

However, when at least one drive is activated, it becomes possible to also train a purely passive user or provide for a support of the movement of an active user. The latter is also referred to as a servo drive.

As each motion element has a separate drive, it is possible that left and right as well as upper and lower extremities can be addressed flexibly and differently, for example when there are differences in the motor skills of the left and right or upper and lower extremities of the user.

In one variant, at least one of the motion elements, in particular each of the motion elements, includes a means for detecting a parameter which is representative for a movement and/or a force which is applied onto the actuating element by a person utilizing the apparatus. Such a means for detecting a movement or a force can also be referred to as a means for determining or a means for detecting a parameter which is representative for a movement and/or force applied by a person onto the actuating element. Such a means for example can be a torque, force, angle and/or rotational speed sensor. Hence, an analysis of the movement and/or force applied by a user onto the actuating element and hence onto the motion element becomes possible.

The measurement quantities detected by the means can be used to define motoric training tasks and/or monitor the fulfillment thereof. For example, playful exercises can be devised, whose task it is to achieve a certain target either by means of a movement or by means of a force or a torque (for example a certain number of revolutions within a specified time, a certain angular position of the actuating elements, a certain angular change of the actuating elements, etc.).

The apparatus includes a control element to which each of the motion elements and each drive is connected. In one variant, the control element also is connected to possibly present means for detecting the movement applied by a person onto the actuating element. In the control element it is possible for example to use the movement detected by the means for detecting the movement applied by a person onto the actuating element as a control variable, for example in order to control the drives. Alternatively or in addition, parameters of the detected movement can be output on an output element, for example acoustically or on a display. Such an output element, for example a display or a loudspeaker, can be provided on an actuating element or on the base element. The output of the parameters then is effected in close proximity to the user. Alternatively or in addition it is also possible to perform the output via a network. In particular, more than two apparatuses can thus be controlled by one control element and the training of several users can thus be controlled at the same time. The connection of the control element to the drives and possibly present output elements or means for detecting a movement applied onto the actuating element by a person can be effected wirelessly or by wire.

In principle, the drives can be adjusted such that the motion elements are moved at the same speed. In addition, it is possible to actuate the drives such that the motion elements are entirely decoupled from each other in operational terms, i.e. do not provide a feedback to the respective other motion element or its drive via the movement carried out by itself. Finally, it is also possible that the drives are actuated in synchronism such that the motion elements are dependent on each other, i.e. are operatively connected with each other with regard to the performed movement and/or the applied force or the applied torque.

The control element can be configured for example in the form of a central, common control unit. It is also possible to assign a separate motor control unit to each drive or motor, wherein the individual motor control units are synchronized with each other. Then, the control parameters for a second motor control unit are known to a first motor control unit so that an individual actuation of the individual drives becomes possible by taking account of the actuation parameters of the respective other drive or the respective other drives.

By means of the control element various training modes can be realized. One possibility is a purely active training. Possibly present drives then do not apply a force. The means for detecting a movement applied by a person onto the actuating element are read out by the control element. Measured torques, forces, angles and/or rotational speeds are evaluated by the control element and used for creating an individual training.

One possibility is a symmetry training, in which it is evaluated whether different movements are applied by the user onto the two motion elements, for example whether pedaling is stronger with one leg than with the other leg or whether the pedals are brought into different angular positions. Alternatively or in addition, a resistance against the movements of the user can also be adjusted, which for example is realized by two passive electric drives. By two such drives the resistance for the left and right extremities can be controlled and adjusted differently.

A further training mode is a semi-active training in which one drive merely acts as a servo drive to support the movements of the user. Measured torques, forces, angles and/or rotational speeds are evaluated by the control device and the drives are actuated such that they optimally support the movement of the user. As at least two drives are provided, the support for the left and right extremities can be controlled differently.

A further training mode yet is a passive training in which the user does not apply his own movements onto the motion elements. Measured torques, forces, angles and/or rotational speeds are evaluated by the control device and the drives are actuated such that they optimally move the extremities of the user. By means of two separate drives the movement of the left and right extremities can be controlled differently. For example, the torques generated by the drives can individually be adjusted for each extremity, e.g. to relieve cramps, blockages or a spasticity or to loosen the muscles. Correspondingly, cramps, blockades or a spasticity of an extremity can also be recognized more easily, as measured torques, forces, angles and/or rotational speeds of both sides can be evaluated separately.

In one variant it is provided to continuously adapt a training program individually created for a user in dependence on the forces applied by the user so that the user always is trained at his performance limit. A training logic realized by means of software evaluates the measured torques, forces, angles and/or rotational speeds and adapts a previously created training program.

The base element for example can be a base plate or a rack which for example can be arranged on a table and/or floor. Several or all motion elements can be arranged on a common base element. In one variant, however, all motion elements each are arranged on a separate base element. Thereby, a particularly high flexibility in the arrangement of the individual motion elements is achieved so that an optimum adaptation of the apparatus to the individual user and the concrete application is possible. When several base elements are present, the same can be movably coupled to each other, e.g. be rotatable or pivotable against each other, or be completely separated from each other mechanically. In particular, it is provided to provide a releasable coupling between individual base elements. This can be realized for example via detent or snap elements which are formed on the base elements. Then, for example two motion elements of the apparatus can either be used separate from each other or in a state coupled with each other, depending on which form of use is preferred by a user or was found to be preferable for a particular training.

At least one of the axes of rotation can be movable with respect to the respective first axis of movement and assume any angle, for example in a range from 0° to 360°, 0° to 180°, 0° to 90°, 80° to 100° or 60° to 120°. An angle of 0° between axis of rotation and first axis of movement means that both are parallel to each other. An angle of 90° means that both axes are perpendicular to each other, i.e. the axis of rotation is parallel to the surface in which the base element extends. In one variant, the axis of movement can be perpendicular to the respective axis of rotation, alternatively or in addition both axes can be immovable relative to each other. It is possible that the axes of rotation can independently be moved relative to the corresponding first axes of movement.

The first axis of movement of at least one of the motion elements or motion modules, in particular of each of the motion elements or motion modules, may be an axis of rotation or a pivot axis. The motion element thereby can be rotated relative to the base element, for example about the first axis of movement in the form of an axis of rotation which extends approximately centrally through the motion element. Alternatively or in addition, a movement can also be effected about the first axis of movement in the form of a pivot axis which extends eccentrically through the motion element. At least one of the motion elements, in particular each of the motion elements, can be movable about the first axis of movement by an angle of at least 90°, in particular at least 120°, in particular at least 150°, in particular at least 180°, in particular at least 210°, in particular at least 240°, in particular at least 270°, in particular at least 300°, in particular at least 330° and quite particularly by an angle of 360°. For example, there can be provided motion ranges of the motion element or the motion elements of 90° to 360° or any other interval which can be formed from the aforementioned angular ranges (for example 120° to 270°). The upper and lower limits are included in the respective ranges. Due to such a possibility of movement, the flexibility of the apparatus is further increased so that for example the (fine) adaptation to the concrete application or the user can be effected only after putting up the motion elements.

Optionally, between at least one of the base elements and at least one of the motion elements an intermediate element is arranged, wherein each intermediate element can be moved about the corresponding first axis of movement relative to the respective base element, independent of another intermediate element. Via the intermediate element, this movement can then be transmitted to the motion element connected to the intermediate element, so that a movability of the motion element around the first axis of movement is obtained.

In one variant, the motion elements are independently movable relative to the respective intermediate element about a respective second axis of movement, wherein the second axis of movement is arranged substantially parallel to the surface in which the respective base element extends. The second axis of movement furthermore is arranged substantially perpendicular to the first axis of movement and also substantially perpendicular to the axis of rotation. The particular effect of such an intermediate element consists in that a movement of the motion elements about a horizontally extending axis also becomes possible, for example to level out irregularities of the standing surface (such as of a table or a floor) or inclinations of the standing surface. In particular, the axis of rotation of at least one of the actuating elements hence can be aligned such that it is substantially perpendicular to the surface of extension of the respective base element. The particular effect of such an alignment consists in providing for a training of the ankle joint, in that the foot is moved relative to the lower leg about a longitudinal axis of the lower leg.

It is possible to mount one actuating element each, which can be moved around the axis of rotation, directly to the motion elements. In one variant, however, it is provided to provide an adapter for fastening such an actuating element, which is movable around the axis of rotation, on the motion elements. By means of such an adapter a simple exchange of different actuating elements for each other is accomplished particularly easily. This is the case in particular when the actuating element can be or is releasably attached to the adapter.

The actuating element for example can be a pedal, similar to a gas/brake or clutch pedal of a motor vehicle. This pedal can then be actuated by the user like a corresponding motor vehicle pedal. This means that with such an actuation the pedal is rotated or pivoted about the axis of rotation. Thereby, for example the ankle joint of the user can be trained optimally.

The actuating element can also be a pedal with pedal arm, similar to a bicycle pedal. The same can then be actuated by a user like a bicycle pedal. In the process, the pedal with pedal arm is rotated about the axis of rotation. The user thereby can train like on a bicycle ergometer. The corresponding pedal in this case is itself movable with respect to the pedal arm.

In a further configuration of the apparatus the actuating element can be a handle with a crank, similar to a handbike. This handle can then be actuated by a user like in a handbike, and in doing so the handle with the crank is rotated about the axis of rotation. The user thereby can train like on a handbike.

One actuating element each can non-releasably or releasably be attached to at least one adapter, in particular to each of the adapters. Releasably attached actuating elements can be exchanged easily, whereby damaged actuating elements can be exchanged or with one motion element different applications in particular can be realized temporally one after the other.

There may be provided means for releasably fixing the motion elements against a movement relative to the respective base element. These means can be adjusting screws or clamps, for example. Alternatively or in addition, they can also be fixing bolts, i.e. pins which each are provided at the motion element or base element, and snap into a grid, for example a drilling grid, which is provided at the respective other one of the two elements. Uncontrolled movements of the motion elements relative to the base element thereby are avoided, which might change the adjustment made.

A concrete possibility of the configuration of the apparatus according to the proposed solution consists in that two actuating elements are provided on a common base element, which are accommodated in a common housing, but nevertheless permit the above-mentioned completely autonomous possibility of movement of the individual motion elements.

An apparatus according to the previous explanations may be used for training the lower and/or upper extremities. This training can be a training without therapeutic purpose, for example a purely athletic training without an intended or unintended therapeutic effect. Alternatively, the training can also have a therapeutic purpose, for example as a rehabilitation measure after a damage of the extremities caused by a disease or an accident or because of a lack of controllability of the extremities by the user, such as a paralysis, for example as a result of a stroke.

In so far, the proposed solution in one aspect relates to a therapeutic method for training the lower and/or upper extremities of a person who needs such training, by using an apparatus according to the previous explanations.

Another aspect of the proposed solution is a method for controlling an apparatus according to the previous explanations, wherein the motion elements and their drives are actuated individually by the control element. The control element for example can read out the means for detecting a movement applied onto the actuating element and further process the control parameters read out in this way. For example, these control parameters can be used as a control variable in order to correspondingly control the drive. Alternatively or in addition, the control parameters can also be output, for example acoustically or on a display.

In one variant, a resistance of the first motion element is adjusted different from a resistance of the second motion element. By such an adjustment a symmetry training can be realized.

Alternatively or in addition, an active movement of the first motion element is adjusted different from an active movement of the second motion element. Thereby, a purely passive user can be trained or a support of the movement of an active user can become possible. The latter is also referred to as a servo drive.

In another variant, a speed or a torque of the first motion element is adjusted different from a speed or a torque of the second motion element. By such an adjustment, a semi-active training to support the movement of a user or a passive training can be realized.

Another aspect of the proposed solution is a method for adjusting an apparatus according to the above explanations, wherein before the beginning of a training the individual motion elements are individually moved relative to the base element about the axes of movement and then are releasably fixed against a movement relative to the base element. Such a method for adjusting the apparatus hence ends before the training is started.

In an alternative aspect, the method for adjusting an apparatus as explained above can also be a first step in a therapeutic method for training the lower and/or upper extremities of a patient by using the apparatus.

Hence, there is also disclosed the possibility of providing a common base element for at least two motion elements, wherein the motion elements cannot be moved around an axis of movement, but merely each have an axis of rotation around which one actuating element each can be moved.

All variants of the described apparatus, the use and the different methods can be combined with each other in any way and can be transferred from the apparatus to the use and the methods as well as vice versa.

BRIEF DESCRIPTION OF THE DRAWINGS

The solution described above will be explained in detail below with reference to Figures and embodiments.

DETAILED DESCRIPTION

Figure 1:
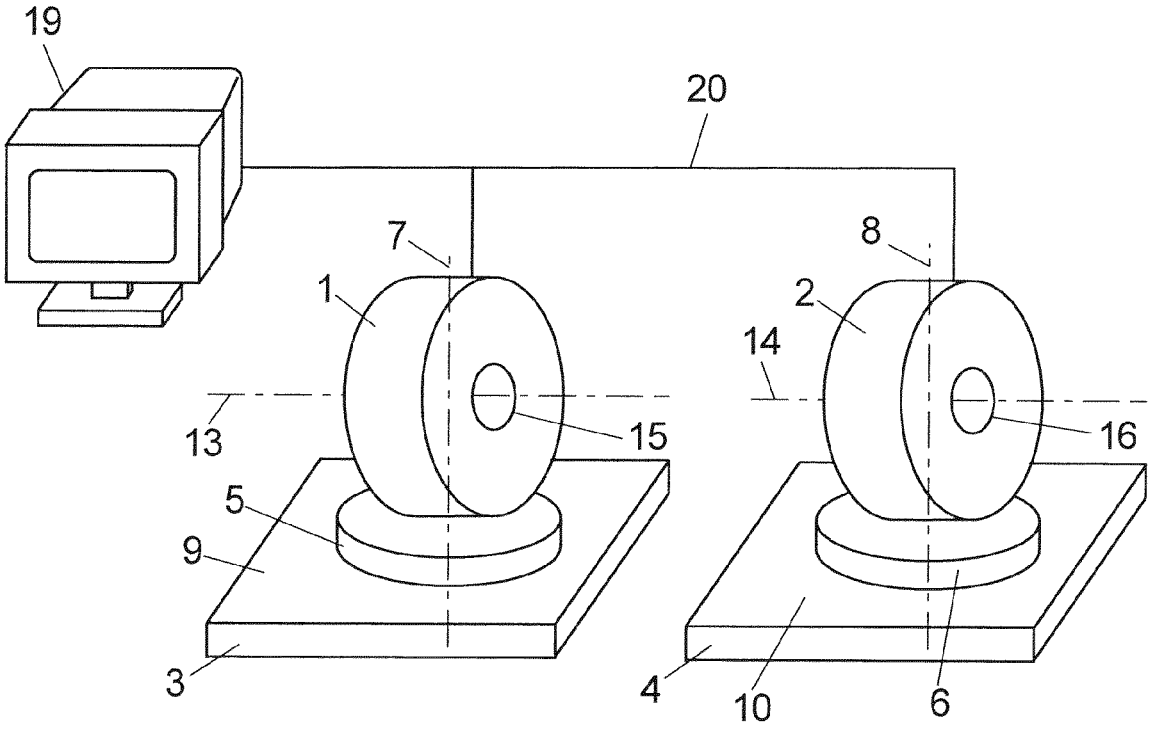
FIG. 1 shows a schematic view of an exemplary embodiment of a training device.

As a first exemplary embodiment, FIG. 1 shows a training device as an apparatus for training the arms and/or the legs of a person.

The training device comprises a first motion module 1 as a first motion element and a second motion module 2 as a second motion element. The first motion module 1 is arranged on a first base plate 3, which serves as a first base element. The second motion module 2 is arranged on a second base plate 4, which serves as a second base element. The shape of the first base plate 3 and of the second base plate 4 is not decisive for the function of the training device.

Between the first motion module 1 and the first base plate 3 a first motion plate 5 is arranged. Between the second motion module 2 and the second base plate 4 a second motion plate 6 is arranged, so to speak. The first motion plate 5 serves to provide for a movement of the first motion module 1 with respect to the first base plate 3 about a first axis of movement 7 of the first motion module 1. In the same way, the second motion plate 5 serves to provide for a movement of the second motion module 2 with respect to the second base plate 4 around a first axis of movement 8 of the second motion module 2.

The first axis of movement 7 of the first motion module 1 and the first axis of movement 8 of the second motion module 2 each are arranged substantially perpendicular to a first surface 9 in which the first base plate 3 extends, or to a second surface 10 in which the second base plate 4 extends.

Expressed in other words, the first axis of movement 7 of the first motion module 1 is aligned vertically when the base plate 3 is arranged horizontally. In the case of a horizontal arrangement of the second base plate 4 this applies identically for the first axis of movement 8 of the second motion module 2.

The first motion module 1 furthermore has a first axis of rotation 13 which extends substantially perpendicular to the first axis of movement 7 of the first motion module 1 and is arranged substantially parallel to the first surface 9. The second motion module 2 likewise has a second axis of rotation 14 which extends substantially perpendicular to the first axis of movement 8 of the second motion module 2 and substantially parallel to the second surface 10. The first motion module 1 can be rotated around the first axis of rotation 13. The second motion module 2 can be rotated around the second axis of rotation 14.

To provide for a simple rotation of the first motion module 1 around the first axis of rotation 13, a first adapter 15 is mounted on the first motion module 1. This first adapter 15 serves for releasably fixing an actuating element movable around the first axis of rotation 13 together with the first motion module 1. In the same way, a second adapter 16 is mounted on the second motion module 2, which serves for releasably fixing an actuating element by which the second motion module 2 can be moved around the second axis of rotation 14.

The first motion module 1 and the second motion module 2 each have a separate electric drive in order to provide for a movement of an actuating element mounted on the first adapter 15 and on the second adapter 16, respectively. These drives are not shown in the representation of FIG. 1. Due to these drives it is also possible to train a purely passive user or to provide for a movement support of an active user of the training device. Due to different drives, left and right extremities and/or upper and lower extremities of the user can be addressed flexibly and differently. This is advantageous in particular when there are differences in the motor skills of the left and right or upper and lower extremities of the user.

The training device of FIG. 1 includes a PC 19 which serves as a common control element for the first motion module 1 and the second motion module 2. Via an electric line 20, it therefor is connected both to the first motion module 1 and to the second motion module 2. Instead of the PC 19 a notebook or a smartphone might also be used as a common control element. The electric line 20, which connects the first motion module 1 and the second motion module 2 to the PC 19, can also be realized by a network. Both a wired and a wireless connection, for example via bluetooth or WLAN, is possible here.

Instead of the variant of an external control by the PC 19 as shown here, it would also be possible to integrate a corresponding control element into the first motion module 1 or into the second motion module 2. Then, no further component would be necessary for the common control element.

As can be seen in FIG. 1, the first base plate 3 and the second base plate 4 are not mechanically coupled to each other. Such a constructive separation between the first base plate 3 and the second base plate 4 however does not exclude that the first motion module 1 and the second motion module 2 are connected to the PC 19 via a common electric line 20.

The first axis of movement 7 of the first motion module 1 and the first axis of movement 8 of the second motion module 2 are axes of rotation which permit a rotation of the first motion module 1 and of the second motion module 2 about 360°. If necessary, a smaller movement of the first motion module 1 around the first axis of rotation 7 and/or of the second motion module 2 around the first axis of rotation 8 can be adjusted.

Different actuating elements which can be attached to the first adapter 15 or to the second adapter 16 will be explained in detail in conjunction with FIGS. 3 to 7.

Figure 2:
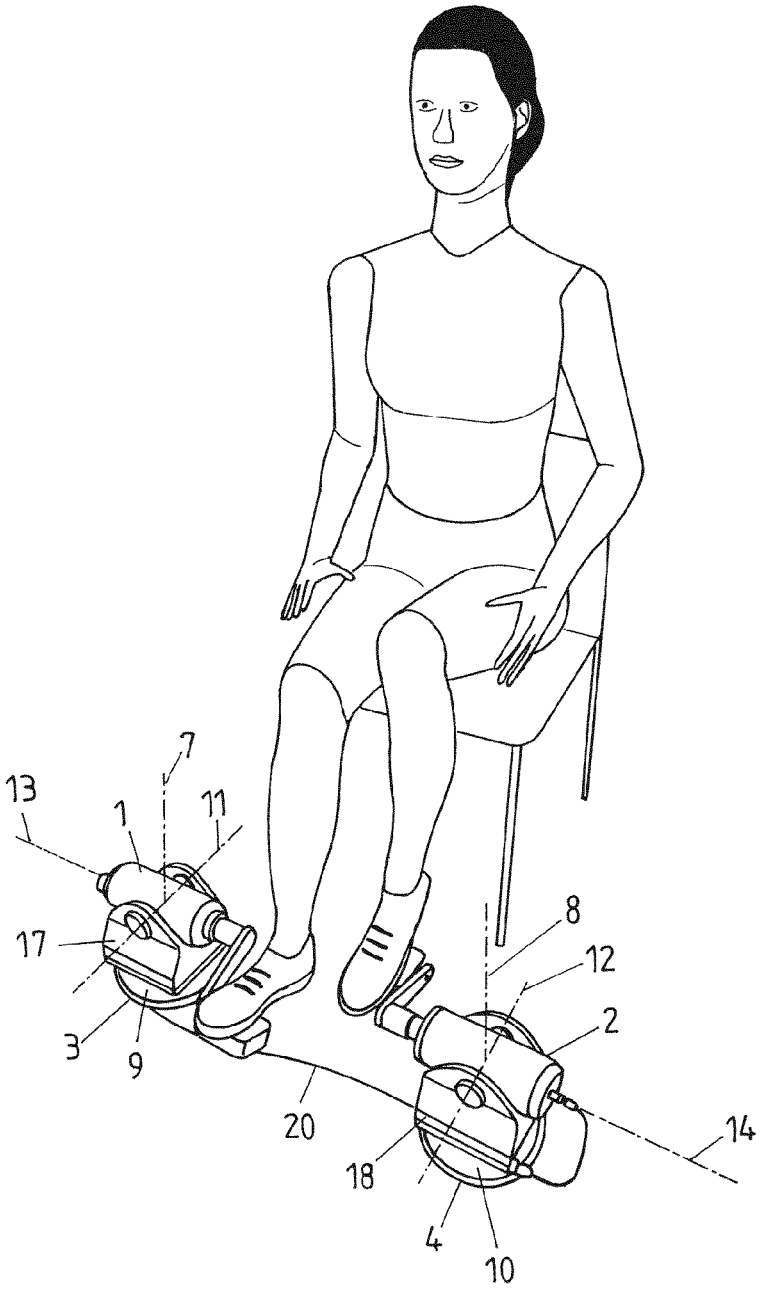
FIG. 2 shows another exemplary embodiment of a training device with a user.

FIG. 2 shows another exemplary embodiment of a training device, which in essential aspects corresponds to the exemplary embodiment of FIG. 1. Identical elements are provided with the same reference numerals. In this connection, reference is made to the above explanations of FIG. 1 and in the following merely the differences between the two exemplary embodiments will be discussed.

In the exemplary embodiment of FIG. 2 a first tilt holder 17, which serves as an intermediate element, is arranged between the first base plate 3 and the first motion module 1. A movement of the first tilt holder 17 relative to the first base plate 3 about the first axis of movement 7 of the first motion module 1 leads to a similar movement of the first motion module 1 relative to the first base plate 3. In addition, it is possible to move the first motion module 1 around a second axis of movement 11. The second axis of movement 11 is arranged substantially perpendicular to the first axis of movement 7 and also substantially perpendicular to the first axis of rotation 13. It extends substantially parallel to the first surface 9 in which the first base plate 3 extends.

In the same way a second tilt holder 18 is arranged between the second motion module 2 and the second base plate 4, which can be moved around the first axis of movement 8 of the second motion module 2. Such a movement leads to a similar movement of the second motion module 2 relative to the second base plate 4. In addition, the second tilt holder 18 also is movable around a second axis of movement 12, which extends substantially perpendicular to the first axis of movement 8 of the second motion module 2 and also substantially perpendicular to the second axis of rotation 14. The second axis of movement 12 also extends parallel to the surface 10 in which the second base plate 4 extends.

By means of the first tilt holder 17 and the second tilt holder 18 an additional degree of freedom of movement can be achieved for the first motion module 1 relative to the first base plate 3 and for the second motion module 2 relative to the second base plate 4. In the exemplary embodiment of FIG. 2 the second axis of movement 11 of the first motion module 1 and the second axis of movement 12 of the second motion module 2 are designed as axes of rotation around which the first motion module 1 and the second motion module 2 can each be steplessly rotated or tilted, namely relative to an orientation of the first axis of rotation 13 and of the second axis of rotation 14 parallel to the surface 10. After being rotated or tilted correspondingly, the first motion module 1 and the second motion module 2 can each be fixed in its rotated or tilted position.

FIGS. 3 to 7 show possible operating modes of an apparatus according to any of the two exemplary embodiments explained above. FIGS. 3 to 7 each show the first motion module 1 and the second motion module 2, wherein various actuating elements have been mounted to the first adapter 15 and to the second adapter 16, respectively.

Figure 3:
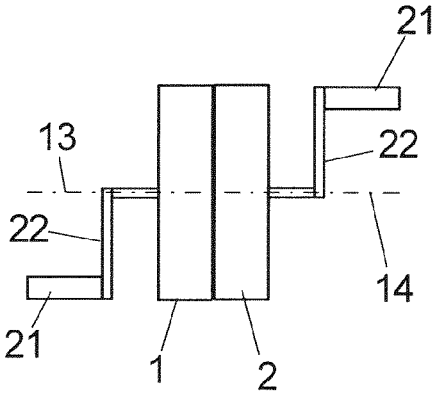
FIG. 3 shows a first operating mode which can be realized with the exemplary embodiment of FIG. 1 or FIG. 2, namely a bicycle training.

As shown in FIG. 3, the actuating element can be a pedal 21 with a pedal arm 22, similar to a bicycle pedal. The same can then be actuated by a user like a bicycle pedal. The pedal 21 with the pedal arm 22 is rotated about the first axis of rotation 13 and/or the second axis of rotation 14. As a result, the user can train like on a bicycle ergometer when such pedals 21 with corresponding pedal arms 22 are mounted on both motion modules 1, 2.

Figure 4:
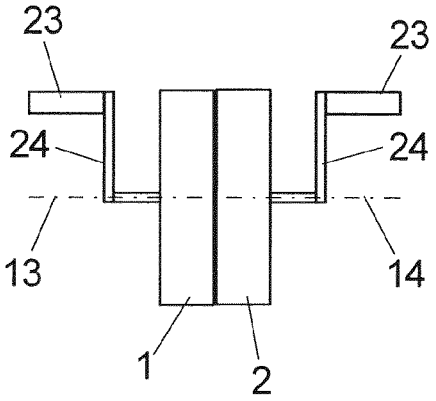
FIG. 4 shows a second operating mode which can be realized with the exemplary embodiment of FIG. 1 or FIG. 2, namely a handbike training.

As shown in FIG. 4, the actuating element can be a handle 23 with a crank 24, similar to a handbike. This handle 23 can then be actuated by a user like in a handbike. The handle 23 with the crank 24 is rotated about the first axis of rotation 13 and/or the second axis of rotation 14. As a result, the user can train like on a handbike when handles 23 with cranks 24 are mounted on both motion modules 1, 2.

Figure 5:
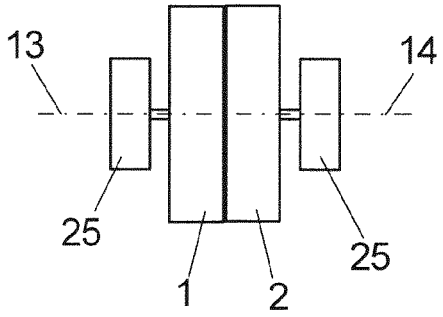
FIG. 5 shows a third operating mode which can be realized with the exemplary embodiment of FIG. 1 or FIG. 2, namely a pedal simulation.

As shown in FIG. 5, the actuating element can be a pedal 25, similar to a gas, brake or clutch pedal of a motor vehicle. This pedal 25 can then be actuated by the user like a corresponding motor vehicle pedal. The pedal 25 is rotated or pivoted about the first axis of rotation 13 and/or the second axis of rotation 14. Thereby, for example the ankle joint of the user can be trained optimally.

In all three of the aforementioned variants the motion elements 1, 2 generally are aligned such that the first axis of rotation 13 and the second axis of rotation 14 substantially are coaligned with each other.

Figure 6:
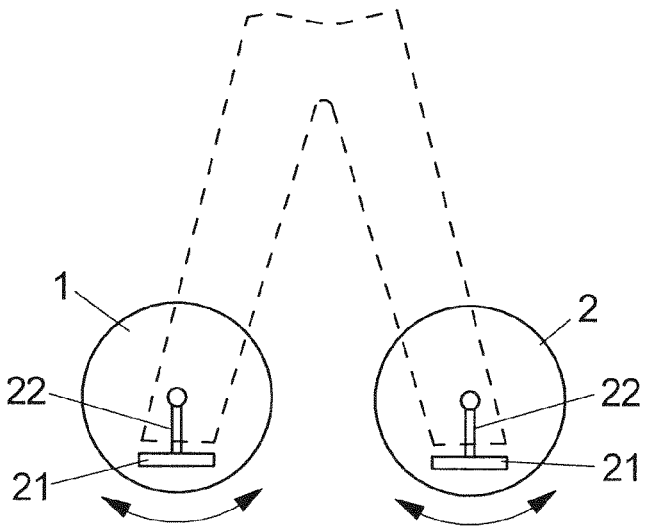
FIG. 6 shows a fourth operating mode which can be realized with the exemplary embodiment of FIG. 1 or FIG. 2, namely a training in a standing position.

Alternatively, the first motion module 1 and the second motion module 2 can also be aligned as shown in FIG. 6. The first axis of rotation 13 and the second axis of rotation 14 are aligned truly parallel to each other. The first motion module 1 and the second motion module 2 furthermore are aligned such that a user can stand with each foot on each pedal 22 with the corresponding pedal arm 21 and at the same time perform swivel movements. For illustration purposes, the legs of a user are schematically shown in FIG. 6 with broken lines.

Figure 7:
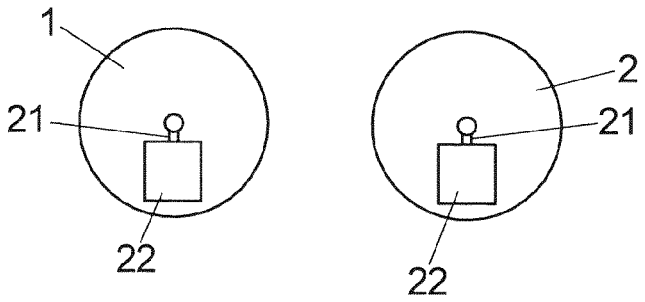
FIG. 7 shows a fifth operating mode which can be realized with the exemplary embodiment of FIG. 1 or FIG. 2, namely a training in a lying position.

Another alternative for the alignment of the first motion module 1 and the second motion module 2 is shown in FIG. 7. The first axis of rotation 13 and the second axis of rotation 14 in turn are aligned truly parallel to each other. Furthermore, the first motion module 1 and the second motion module 2 furthermore are aligned such that a lying user can put a foot on each pedal 22 with the corresponding pedal arm 21 and at the same time perform swivel movements.

The invention claimed is:

1. An apparatus for training a person's lower and/or upper extremities, comprising:

at least two motion elements, wherein:

a first of the at least two motion elements is arranged on a first base plate and a second of the at least two motion elements is arranged on a second base plate, the first base plate and the second base plate are configured to be arranged on a table or a floor and are capable of independent movement and placement on the table or floor with respect to each other, the motion elements each have an axis of rotation around which an actuating element each can be moved, the first of the at least two motion elements is movable relative to the first base plate about a first axis of movement of the first motion element independently from the second of the at least two motion elements that is moveable relative to the second base plate about a first axis of movement of the second motion element, the first axis of movement of the first motion element extends substantially perpendicular to an extension surface of the first base plate, each motion element has a separate drive in order to rotate the actuating elements about the axis of rotation, and the apparatus includes a control element being designed and configured to individually actuate each drive in order to provide for a movement of each drive independent of a movement of another drive during operation of the apparatus.

2. The apparatus according to claim 1, wherein at least one of the motion elements includes a means for detecting at least one variable applied by a person onto the actuating element, which variable is selected from the group consisting of torque, force, angular velocity and rotational speed.

3. The apparatus according to claim 1, wherein at least one of the motion elements is movable by an angle of at least 90° about the first axis of movement.

4. The apparatus according to claim 1, wherein:

an intermediate element is arranged between the base element and least one of the motion elements.

5. The apparatus according to claim 4, wherein:

each motion element has a respective intermediate element, the motion elements each are independently movable about a second axis of movement relative to the respective intermediate element, and the second axis of movement extends substantially parallel to the extension surface of the respective base element, substantially perpendicular to the first axis of movement and substantially perpendicular to the axis of rotation.

6. The apparatus according to claim 4, wherein the intermediate element is movable about the first axis of movement relative to the base element independent of another intermediate element arranged between the base element and another of the motion elements.

7. The apparatus according to claim 1, wherein the first axis of movement extends substantially perpendicular to the axis of rotation.

8. The apparatus according to claim 1, wherein at least one of the motion elements includes an adapter for fixing one of the actuating elements to be movable about the axis of rotation.

9. The apparatus according to claim 8, wherein to the adapter one of the actuating elements is releasably attached to the adapter, wherein the actuating elements are chosen from the group consisting of i) pedals, ii) pedals with pedal arm, and iii) handles with crank.

10. The apparatus according to any claim 1, further comprising a means for releasably fixing the motion elements against a movement relative to the base element.

11. A method for controlling the apparatus according to claim 1, wherein the motion elements and their drives are individually actuated by the control element.

12. The method according to claim 11, wherein a resistance of the first motion element is adjusted different from a resistance of the second motion element and/or an active movement of the first motion element is adjusted different from an active movement of the second motion element.

13. The method according to claim 11, wherein a speed of the first motion element is adjusted different from a speed of the second motion element.

14. The apparatus according to claim 1, wherein at least one of the motion elements is movable by an angle lying in a range of from 210° to 360° about the first axis of movement.

* * * * *